US007209151B2

(12) United States Patent
Huang

(10) Patent No.: US 7,209,151 B2
(45) Date of Patent: Apr. 24, 2007

(54) DISPLAY CONTROLLER FOR PRODUCING MULTI-GRADATION IMAGES

(75) Inventor: Li-Shin Huang, Taipei Hsien (TW)

(73) Assignee: Aimtron Technology Corp., Hsinchu (TW)

( * ) Notice: Subject to any disclaimer, the term of this patent is extended or adjusted under 35 U.S.C. 154(b) by 636 days.

(21) Appl. No.: 10/707,461

(22) Filed: Dec. 16, 2003

(65) Prior Publication Data

US 2005/0128222 A1 Jun. 16, 2005

(51) Int. Cl.
*G09G 5/10* (2006.01)
*G09G 3/36* (2006.01)

(52) U.S. Cl. ..... 345/690; 345/89

(58) Field of Classification Search ..... 345/89, 345/690, 87, 90, 691
See application file for complete search history.

(56) References Cited

U.S. PATENT DOCUMENTS 4,769,713 A 9/1988 Yasui
4,921,334 A 5/1990 Akodes
5,185,602 A 2/1993 Bassetti, Jr. et al.
5,252,959 A 10/1993 Kono
5,313,224 A 5/1994 Singhal et al.
5,389,948 A 2/1995 Liu
5,714,974 A 2/1998 Liu
5,777,590 A * 7/1998 Saxena et al. ..... 345/89
6,064,359 A 5/2000 Lin et al.
6,084,561 A * 7/2000 Kudo et al. ..... 345/89
6,353,435 B2 * 3/2002 Kudo et al. ..... 345/204
6,791,576 B1 * 9/2004 Lin ..... 345/690

* cited by examiner

*Primary Examiner*—Kevin M. Nguyen
(74) *Attorney, Agent, or Firm*—Winston Hsu

(57) ABSTRACT

Through a plurality of consecutive frames, a display controller produces a multi-gradation image on a display device formed by a plurality of binary-state pixels in an array. The display controller includes an image memory for providing each of the pixels with gradation data. A waveform pattern selector outputs a waveform pattern selecting signal for causing a waveform pattern memory to provide any two adjacent pixels with two different sets of waveform pattern signals. The plurality of consecutive frames are operated at a fixed frame rate, which is set high enough for preventing visual disturbances.

20 Claims, 6 Drawing Sheets

FIG. 6(a)

61 60

| | | | | | |
|---|---|---|---|---|---|
| $R_{11}$ | $G_{11}$ | $B_{11}$ | $R_{12}$ | $G_{12}$ | $B_{12}$ |
| $R_{21}$ | $G_{21}$ | $B_{21}$ | $R_{22}$ | $G_{22}$ | $B_{22}$ |
| $R_{31}$ | $G_{31}$ | $B_{31}$ | $R_{32}$ | $G_{32}$ | $B_{32}$ |
| $R_{41}$ | $G_{41}$ | $B_{41}$ | $R_{42}$ | $G_{42}$ | $B_{42}$ |

FIG. 6(b)

60

| | | | | | |
|---|---|---|---|---|---|
| WP1 | WP2 | WP1 | WP2 | WP1 | WP2 |
| WP2 | WP1 | WP2 | WP1 | WP2 | WP1 |
| WP1 | WP2 | WP1 | WP2 | WP1 | WP2 |
| WP2 | WP1 | WP2 | WP1 | WP2 | WP1 |

FIG. 6(c)

60

| | | | | | |
|---|---|---|---|---|---|
| WP1 | WP1 | WP1 | WP2 | WP2 | WP2 |
| WP2 | WP2 | WP2 | WP1 | WP1 | WP1 |
| WP1 | WP1 | WP1 | WP2 | WP2 | WP2 |
| WP2 | WP2 | WP2 | WP1 | WP1 | WP1 |

DISPLAY CONTROLLER FOR PRODUCING MULTI-GRADATION IMAGES

BACKGROUND OF INVENTION

1. Field of the Invention

The present invention relates to a display controller and, more particularly, to a display controller capable of producing multi-gradation images on a display device constructed by binary-state pixels in an array.

2. Description of the Related Art

Digitally commanded display devices usually refer to optoelectronic apparatus using a plurality of pixels as elementary light source units, in which each pixel is switched between binary states ON and OFF (or White and Black) under the control of digital electronic signals. As the elementary light source units, the pixels may be emissive, transmissive, and reflective types. Liquid display devices, light-emitting diode display devices, plasma display device, and the like are some examples of the digitally commanded display devices.

Since the binary-state pixels are limited to being operated at either the state ON or the state OFF, some kind of display techniques is necessarily utilized or developed in order to produce multi-gradation images on the display device consisting of the binary-state pixels (hereinafter referred to as a binary display device). For example, an analog modulation technique proposes providing the pixels of the binary display device with a plurality of driving signals, each of which has a different intermediate level of voltage, thereby possibly operating the pixels at several less than 100% ON/OFF states for achieving a display of multi-gradation. Such an analog modulation technique has a drawback of requiring a complicated driver.

Another prior art is a pulse width modulation technique for controlling duty cycles between the binary states ON and OFF and utilizing a low pass filtering function of the human eye to achieve a perception of multi-gradation. Such a pulse width modulation technique suffers from a complicated controller and a sophisticated controlling algorithm.

Alternatively, a prior art called frame rate modulation technique is proposed to produce a perception of multi-gradation through a display of consecutive frames. This prior art is similar in principle to the pulse width modulation technique. However, some undesired visual disturbance such as flickering is usually perceived in the displayed images.

Still another prior art is a dithering technique, which employs a dither matrix to eliminate the flickering of the displayed images. However, such a dithering technique requires a sophisticated controlling algorithm and circuitry, resulting a low utility ratio of digital information. Even worse, some undesired visual disturbance such as stripes might be perceived in the displayed image.

SUMMARY OF INVENTION

In view of the above-mentioned problems, an object of the present invention is to provide a display controller capable of producing multi-gradation images on a display device constructed by binary-state pixels in an array.

Through a plurality of consecutive frames, a display controller produces a multi-gradation image on a display device formed by a plurality of binary-state pixels in an array. The plurality of pixels is classified into a plurality of pixel groups having an identical size. The display controller includes an image memory for providing each of the pixels with gradation data. The gradation data is indicative of a gradation level to be produced at the desired pixel. A waveform pattern memory provides the display device with plural sets of waveform pattern signals, each set having an identical number of waveform pattern signals, each waveform pattern signal having a predetermined number of bits and producing a different gradation level when applied to a pixel, each bit being provided for displaying during a corresponding frame of the plurality of consecutive frames. A waveform pattern selector outputs a waveform pattern selecting signal such that the waveform pattern memory provides two adjacent pixel groups with two different sets of the plural sets of waveform pattern signals, respectively. The two different sets of the plural sets of waveform pattern signals provided for the two adjacent pixel groups, respectively, are so designed as to operate the two adjacent pixel groups at two different states during at least one frame of the plurality of consecutive frames. The waveform pattern memory determines a selected set of the plural sets of waveform pattern signals in response to the waveform pattern selecting signal, determines a selected waveform pattern signal of the selected set of waveform pattern signals in response to the gradation data, and provides the bits of the selected waveform pattern signal, one bit per frame, over the plurality of consecutive frames. The plurality of consecutive frames is displayed at a frame rate high enough for preventing visual disturbances.

A method of producing a multi-gradation image on a display device formed by a plurality of binary-state pixels in an array through a plurality of consecutive frames is disclosed. An elementary 2×2 pixel cell is defined on the display device. The elementary 2×2 pixel cell has two pixels along a first diagonal and two pixels along a second diagonal. A first set of waveform pattern signals and a second set of waveform pattern signals are defined, each set having an identical number of waveform pattern signals, each waveform pattern signal having a predetermined number of bits and producing a different gradation level when applied to a pixel, each bit being provided for displaying during a corresponding frame of the plurality of consecutive frames. The two pixels along the first diagonal are provided with the first set of waveform pattern signals and the two pixels along the second diagonal with the second set of waveform pattern signals. The two pixels along the first diagonal and the two pixels along the second diagonal are operated at different states during at least one frame of the plurality of consecutive frames. The plurality of consecutive frames are displayed at a frame rate high enough for preventing visual disturbances.

Preferably, the multi-gradation image has $2^m$ gradations and is produced through consecutive $2^n$ frames where m is equal to or smaller than n and n is equal to or larger than 3. Each set of the two sets of waveform pattern signals has $2^m$ waveform pattern signals for producing the $2^m$ gradations, respectively, each waveform pattern signal having $2^n$ bits. The frame rate is equal to or higher than $(2^n \times 15)$ Hz[0013] Preferably, the waveform pattern memory is restricted to provide only two sets of waveform pattern signals. The waveform pattern selector outputs the waveform pattern selecting signal in response to a least significant bit of the column number and a least significant bit of the row number. The waveform pattern memory stores a first set of the two sets of waveform pattern signals and derives a second set of the two sets of waveform pattern signals from the first set of the two sets of waveform pattern signals by using the waveform pattern selecting signal.

Preferably, each of the plurality of pixel groups is formed by a single pixel of the plurality of binary-state pixels.

Preferably, the display device is a color display device such that each of the plurality of binary-state pixels is constructed to produce one of three primary colors: red, green, and blue. Each of the plurality of pixel groups is formed by a single pixel of the plurality of binary-state pixels regardless of its color.

Preferably, the display device is a color display device such that every three pixels of the plurality of binary-state pixels makes up a color pixel unit and produces three primary colors: red, green, and blue, respectively. Each of the plurality of pixel groups is formed by a single one of the color pixel units.

BRIEF DESCRIPTION OF DRAWINGS

The above-mentioned and other objects, features, and advantages of the present invention will become apparent with reference to the following descriptions and accompanying drawings, wherein:

FIG. 3(*b*) is a schematic diagram showing several possible spatial patterns of any 2×2 pixel array of a binary display device during a frame according to the present invention;

FIGS. 6(*a*) to 6(*c*) are schematic diagrams showing a color display device according to the present invention.

DETAILED DESCRIPTION

As described above, the prior art for producing multi-gradation images on a binary display device suffers from a variety of shortcomings. Fortunately, a display controller according to the present invention does not only produce in an effective way multi-gradation images on a binary display device, but also provides the following advantages: (1) a simpler circuit configuration; (2) an easier-executed controlling algorithm; (3) a thorough prevention of visual disturbances (such as flickering and stripes); (4) a sufficient utility ratio of digital information; and (5) a significant enhancement of a speed of processing digital image signals. Therefore, the display controller according to the present invention employs an easier-executed controlling algorithm to operate the binary display device, achieving a homogeneous multi-gradation display without stripes and directly preventing from the flickering phenomenon by using integrating mechanisms of the human eye under a high enough frame rate. The preferred embodiments according to the present invention will be described in detail with reference to the drawings.

Figure 1:
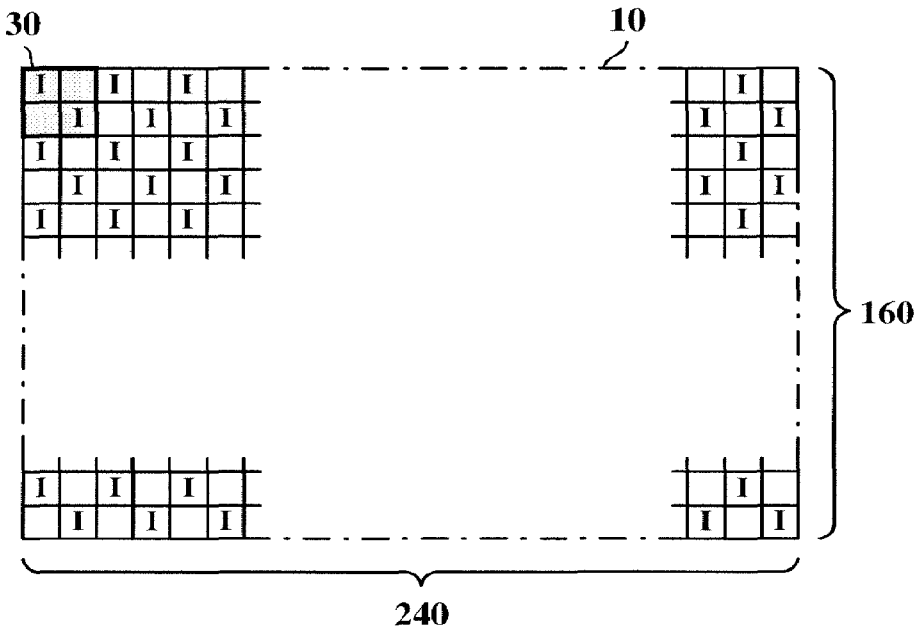
FIG. 1 is a schematic diagram showing a binary display device consisting of binary-state pixels in an array.

Referring to FIG. 1, a binary display device 10 is constructed by 240×160 binary-state pixels, which are arranged in an array with 240 columns and 160 rows. It should be noted that although the binary display device 10 shown in FIG. 1 has a dimension of 240×160 binary-state pixels, the present invention is not limited to this example and may be applied to other binary display devices with any dimensions. In order to produce multi-gradation images on the binary display device 10, a multi-gradation image may be temporally distributed into a plurality of consecutive frames to be displayed with a fixed rate, in which each frame is displayed by designating the pixels of the binary display device 10 with either of the binary states ON/OFF in accordance with a particular spatial pattern. As a result, the multi-gradation image may be effectively perceived on the binary display device 10 under the temporally/spatially integrating mechanisms of the human eye.

Figure 2:
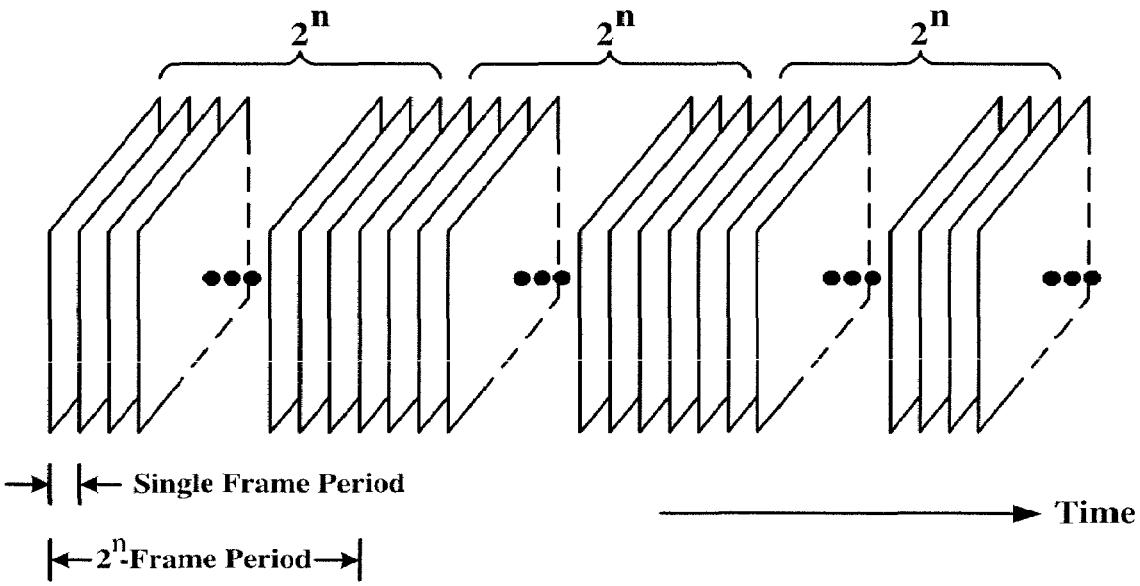
FIG. 2 is a schematic diagram showing an image with $2^n$ gradations produced on a binary display device through $2^n$ frames.

It is assumed that the binary display device 10 is operated to display a series of images, each of which has $2^n$ gradations (n is a positive integer). As shown in FIG. 2, each of the $2^n$-gradation images consists of $2^n$ frames, in which any two adjacent frames are separated by a fixed frame period. Furthermore, a display of the 2 n-th frame of the current $2^n$-gradation image is followed by a display of the first frame of the next $2^n$-gradation image after the fixed frame period. In other words, the binary display device 10 is operated to consecutively display frames at a fixed frame rate, causing the human eye to perceive every combination of $2^n$ frames as a $2^n$-gradation image. More specifically, it is necessary for the frame rate to rise until a significantly high value in order to utilize the temporally integrating mechanism of the human eye. In principle, the higher frame rate facilitates much more the temporally integrating mechanism of the human eye, resulting in a higher quality multi-gradation image. The prior art restricts the frame rate between approximately 50 and 120 Hz, and may produce some fair $2^n$-gradation images without flickering when n is equal to or smaller than 2. However, when n is equal to or larger than 3, the prior art needs to employ the complicated controlling algorithm and/or the sophisticated dithering matrix for compensating the weakness of the lower frame rate, which would otherwise cause the flickering phenomenon.

In a preferred embodiment according to the present invention, the frame rate is set equal to or higher than ($2^n$×15) Hz. Under such a condition, any two frames with the same frame serial number among the two consecutive $2^n$-gradation images are displayed at a rate equal to or higher than 15 Hz, i.e., once every $2^n$ frames. In other preferred embodiments according to the present invention, the most appropriate frame rate may be determined by computer simulations or practical inspections as long as the frame rate is high enough for preventing the human eye from perceiving the flickering phenomenon.

Figure 3A:
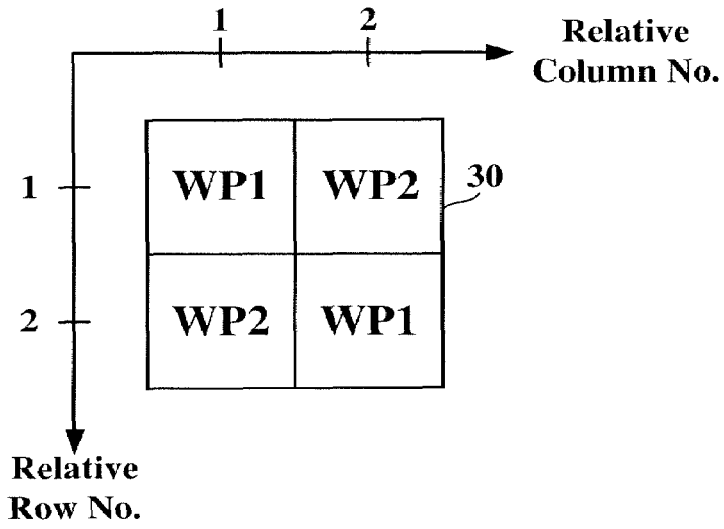
FIG. 3(*a*) is a schematic diagram showing two adjacent, either vertically or horizontally, pixels of a binary display device alternately provided with two different sets of waveform pattern signals.
Figure 3B:
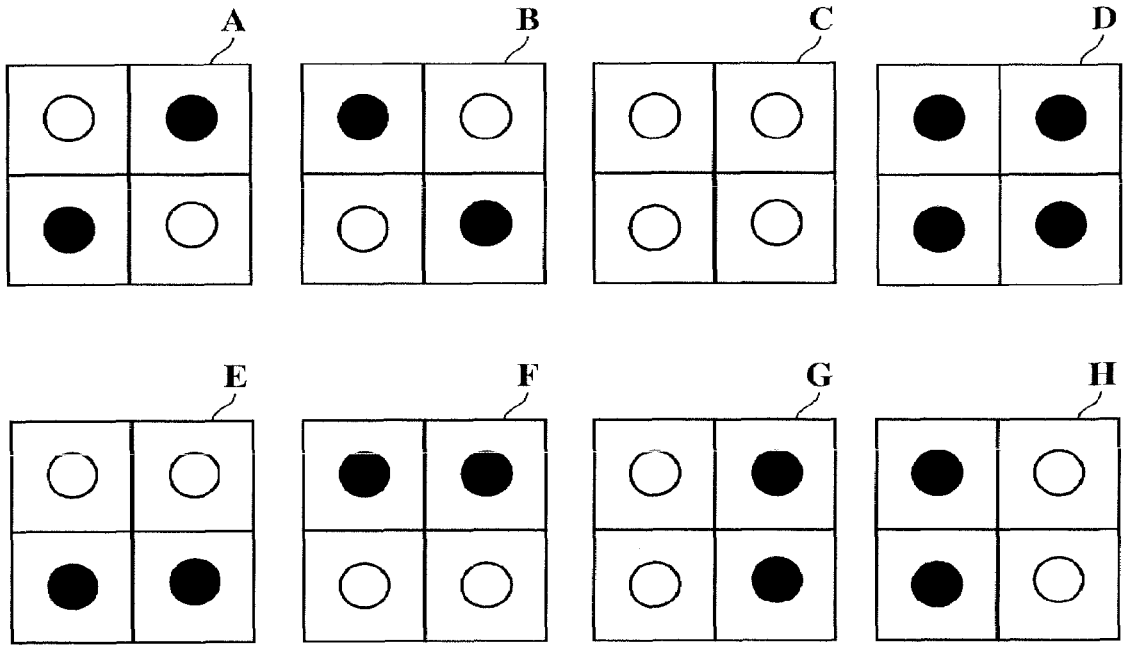

In order to utilize the spatially integrating mechanism of the human eye, the display controller according to the present invention alternately provides the adjacent, either vertically or horizontally, pixels of the binary display device 10 with two different sets of waveform pattern signals. More specifically, as shown in FIG. 3(*a*), an elementary 2×2 pixel cell 30 includes four pixels, in which two pixels located along one diagonal receives a first set of waveform pattern signals WP1 and the other two pixels located along another diagonal receives a second set of waveform pattern signals WP2. In the present invention, the second set of waveform pattern signals WP2 is designed to be different from the first set of waveform pattern signals WP1, which would be described in more detail later. Referring back to FIG. 1, the binary display device 10 can be considered as a construction of a plurality of elementary 2×2 pixel cells 30 shown in FIG. 3(*a*). As a result, the pixels designated with a symbol I are representative of the pixels receiving the first set of waveform pattern signals WP1 while the blank pixels designated with nothing are representative of the pixels receiving the second set of waveform pattern signals WP2. Therefore, any two adjacent pixels of the binary display device 10, regardless of vertical or horizontal adjacency, receive two different sets of waveform pattern signals WP1 and WP2.

FIG. 3(*b*) is a schematic diagram showing several possible spatial patterns A to H of any 2×2 pixel array of the binary display device 10 during a frame. In FIG. 3(*b*), the pixels designated with a hollow circle are operated at the state ON (or White) of the binary states while the pixels designated with a solid circle are operated at the state OFF (or Black) of the binary states. In the present invention, the two different sets of waveform pattern signals WP1 and WP2 provided for the two adjacent pixels of the binary display device 10, respectively, are designed in such a manner that the two adjacent pixels are operated at different states among the binary states ON and OFF during at least one frame of the $2^n$ frames, such as the spatial patterns A or B in FIG. 3(*b*). In other words, the operating states of the two adjacent pixels are spatially interlaced. Consequently, the switching rates of the binary-state pixels are enhanced to become approximately twice higher under the spatially integrating mechanism of the human eye. Through such a manner, in the above-described embodiment with the frame rate set equal to or higher than ($2^n$×15) Hz, the switching rate of pixels would be perceived by the human eye equal to or higher than 30 Hz even if the pixels are individually switched only once during the $2^n$ frames. Therefore, the display controller according to the present invention much better prevents from the flickering phenomenon and stripes.

Figure 4A:
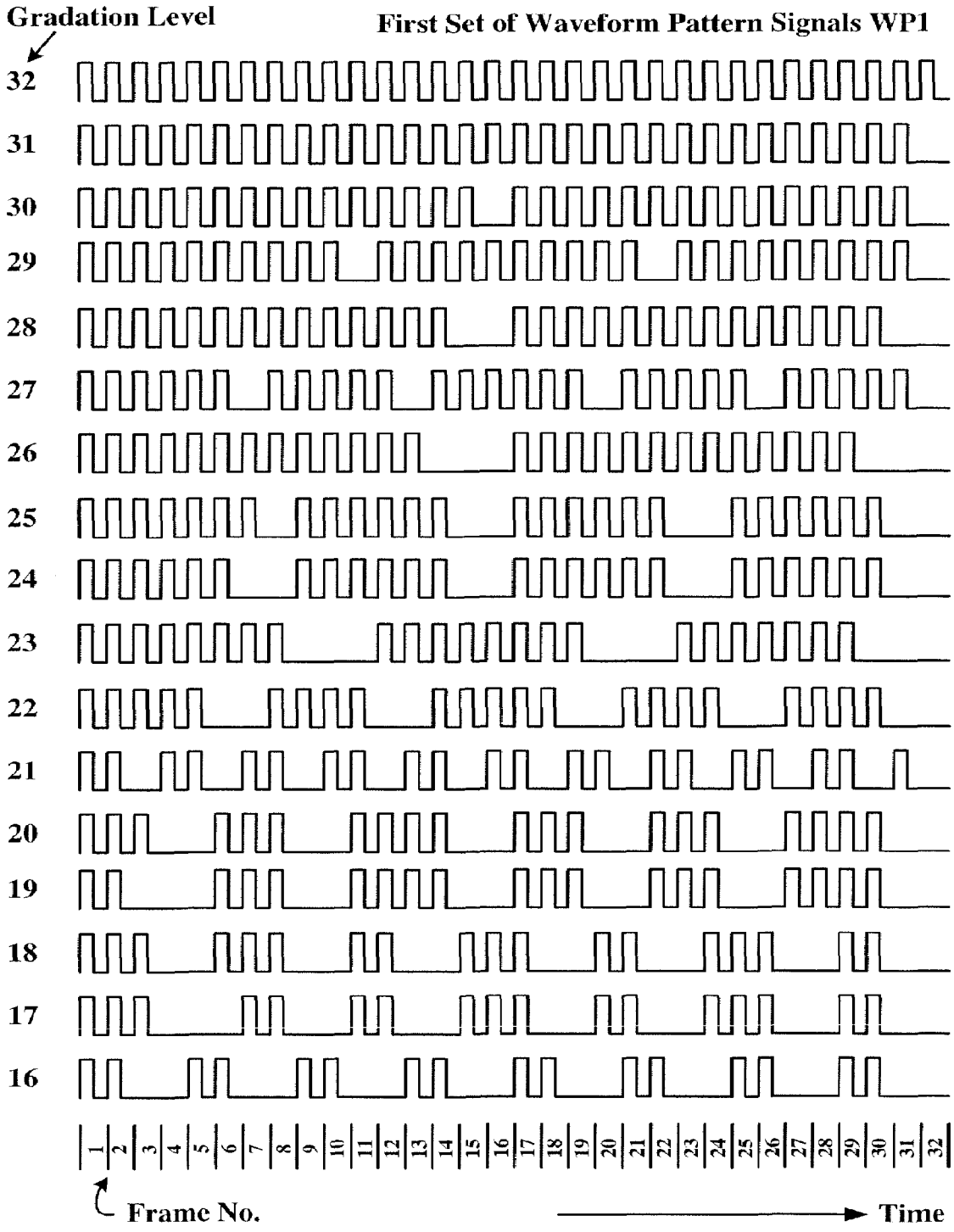
FIGS. 4(*a*) and 4(*b*) are timing charts showing two exemplary sets of waveform pattern signals provided by a display controller according to the present invention.
Figure 4B:
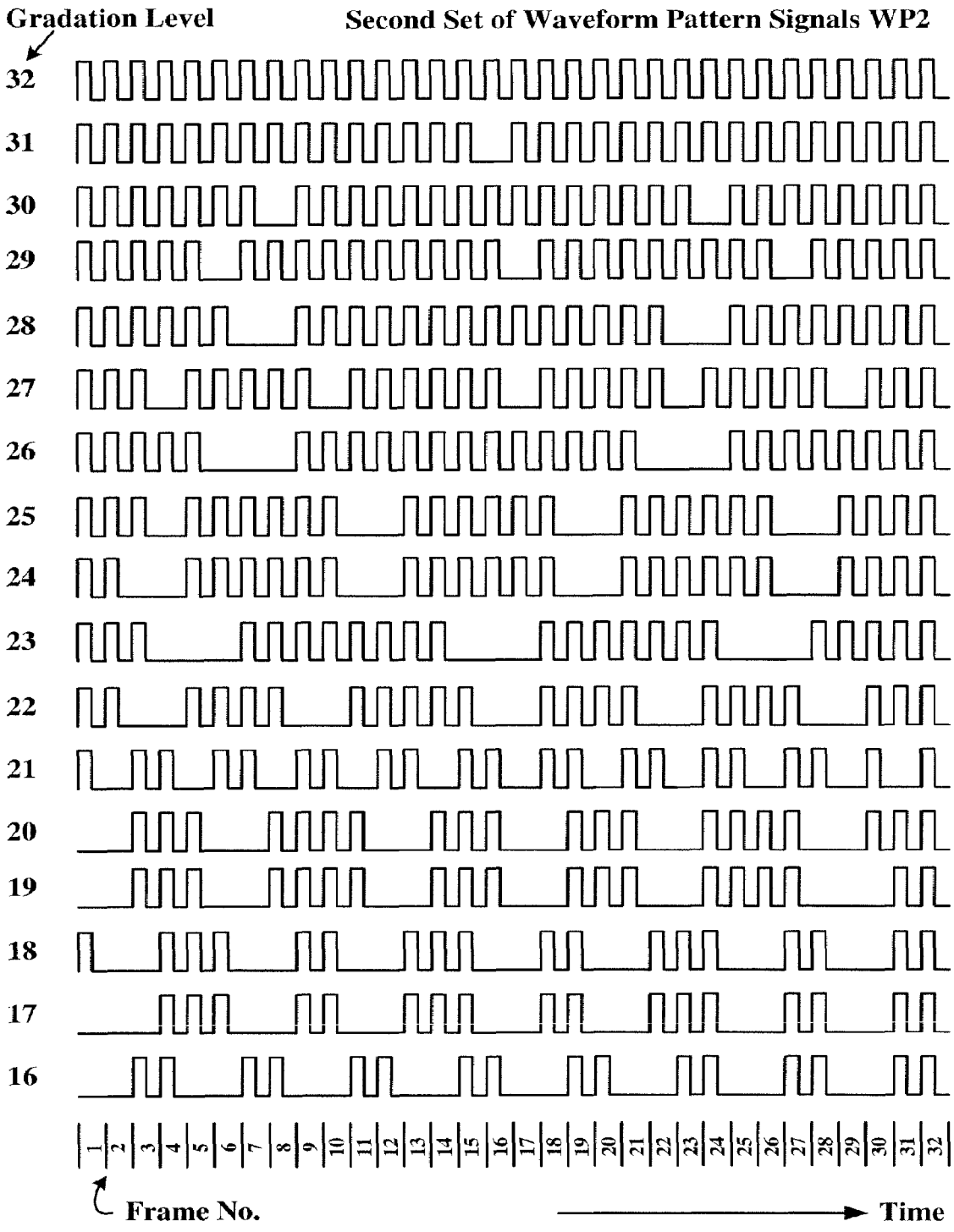

FIGS. 4(*a*) and 4(*b*) are timing charts showing two exemplary sets of waveform pattern signals WP1 and WP2 provided by a display controller according to the present invention. The two sets of waveform pattern signals WP1 and WP2 shown in FIGS. 4(*a*) and 4(*b*) extend in time for 32 frames and, therefore, are able to display an image with $2^5$ (=32) gradations. In FIGS. 4(*a*) and 4(*b*), a m-th level waveform pattern signal is so designed as to have pulses during m frames of the 32 frames and have no pulse during the remaining (32-m) frames. The m pulses of the m-th level waveform pattern signal of the first set of waveform pattern signals WP1 are distributed over m frames of the 32 frames in a different way as compared with the m frames the m pulses of the corresponding m-th level waveform pattern signal of the second set of waveform pattern signals WP2 are distributed over. As described above, the two different sets of waveform pattern signals WP1 and WP2 provided for the two adjacent pixels of the binary display device 10, respectively, are designed in such a manner that the two adjacent pixels are operated at different states among the binary states ON and OFF during at least one frame of the $2^n$ frames. Through such different distributions of pulses, the switching rates of the binary-state pixels are enhanced to become approximately twice higher under the spatially integrating mechanism of the human eye. Each waveform pattern signal of the two different sets of waveform pattern signals WP1 and WP2 may be considered as or implemented by a digital bit sequence. For example, the $22^{nd}$ level waveform pattern signal of the first set of waveform pattern signals WP1 is [11111001111001111100111100111100] wherein the bit 1 is representative of a pulse while the bit 0 is representative of no pulse. Each bit is applied during a corresponding frame, in sequence over the consecutive 32 frames. Since each bit has binary states 1 and 0, the operations of the binary-state pixels are appropriately controlled.

It should be noted that there are only the $16^{th}$ to $32^{nd}$ level waveform pattern signals shown in FIGS. 4(*a*) and 4(*b*) because in this embodiment the $1^{st}$ to $15^{th}$ level waveform pattern signals are designed to be the complements or inverted signals of the $31^{st}$ to $17^{th}$ level waveform pattern signals, respectively, and are omitted in the drawings for simplification. In another embodiment according to the present invention, the $1^{st}$ level waveform pattern signal may be so designed as to have no pulse over the total 32 frames.

Although the two sets of waveform pattern signals WP1 and WP2 shown in FIGS. 4(*a*) and 4(*b*) are applied to produce the 32-gradation images, the present invention is not limited to this example and may be applied to choose 16 waveform pattern signals from each of the two sets of waveform pattern signals WP1 and WP2 for producing 16-gradation images. Similarly, the present invention may be applied to choose 8 waveform pattern signals from each of the two sets of waveform pattern signals WP1 and WP2 for producing 8-gradation images.

Figure 5A:
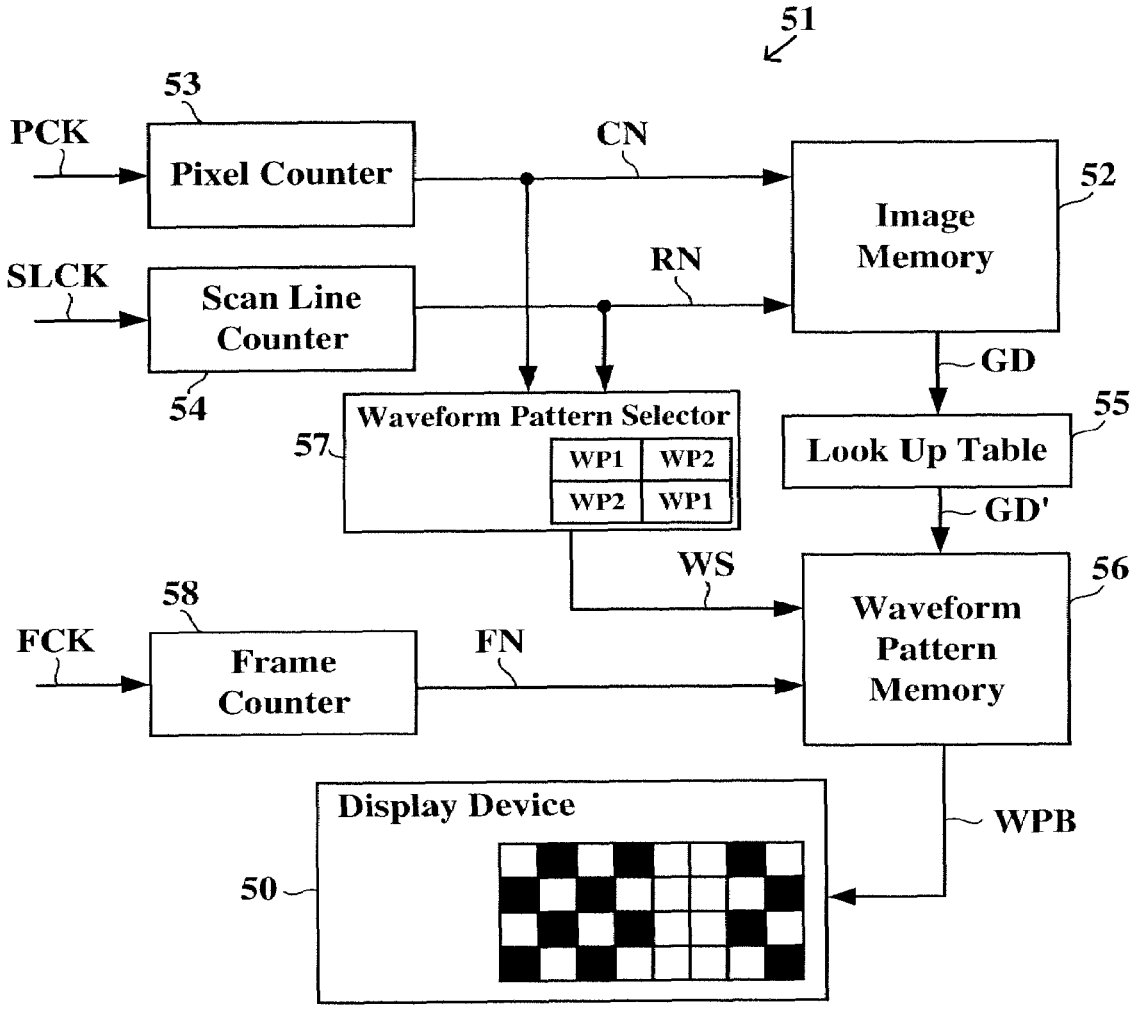
FIGS. 5(*a*) and 5(*b*) are circuit block diagrams showing a display controller according to the present invention.
Figure 5B:
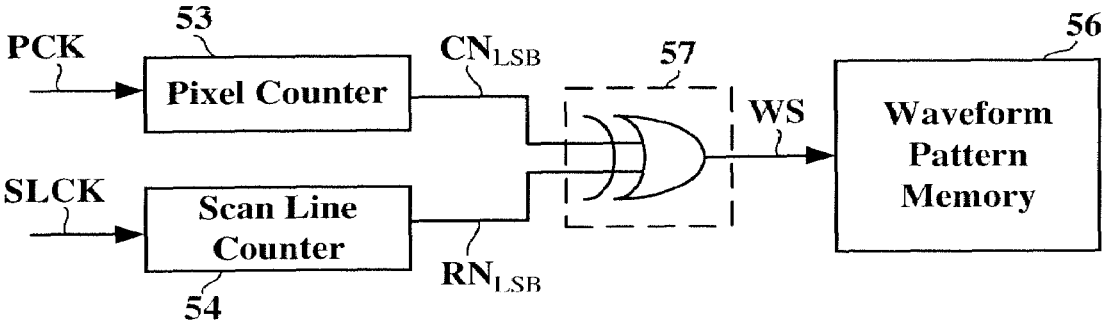

Hereinafter will be described in detail some circuit configuration and operations of a display controller 51 for producing multi-gradation images on a display device 50 with reference to FIGS. 5(*a*) and 5(*b*). Referring to FIG. 5(*a*), an image memory 52 stores gradation data indicative of the gradation levels of the pixels of the binary-state pixel array of the display device 50. The image memory 52 is accessed in accordance with a column number signal CN output from a pixel counter 53 and a row number signal RN output from a scan line counter 54. The pixel counter 53 and the scan line counter 54 are operated in synchronization with a pixel clock PCK and a scan line clock SLCK, respectively. In response to the column number signal CN and the row number signal RN, the image memory 52 outputs gradation data GD to be displayed on the pixel addressed by the column number signal CN and the row number signal RN. Although the gradation data GD may be directly input into a waveform pattern memory 56, the gradation data GD in a preferred embodiment according to the present invention is supplied through a look-up table 55 to the waveform pattern memory 56. Functions of the look-up table 55 typically include expanding the number of bits of the gradation data GD, performing Gamma corrections on the gradation data GD, or the like in order to enhance the quality of the images to be displayed. The transferred gradation data GD from the lookup table 55 is input into the waveform pattern memory 56. The waveform pattern memory 56 stores a predetermined number of digital bit sequences, which are corresponding to the waveform pattern signals, e.g., those shown in FIGS. 4(*a*) and 4(*b*), according to the present invention.

On the other hand, in response to the column number signal CN and the row number signal RN, a waveform pattern selector 57 outputs a waveform pattern selecting signal WS based on the elementary 2×2 pixel cell 30 shown in FIG. 3(*a*). The waveform pattern selecting signal WS is input into the waveform pattern memory 56 for determining which one of the two sets of waveform pattern signals WP1 and WP2 should be selected. Meanwhile, a frame counter 58 outputs in synchronization with a frame clock FCK a frame number signal FN to the waveform pattern memory 56. In response to the transferred gradation data GD, the waveform pattern selecting signal WS, and the frame number signal FN, the waveform pattern memory 56 sequentially outputs the bits WBP of the selected waveform pattern signal, one bit per frame, to the binary display device 50, thereby producing the multi-gradation images. In one embodiment, the waveform pattern memory 56 may store two sets of waveform pattern signals WP1 and WP2 therein, and determine which set should be selected based on the waveform pattern selecting signal WS. In another embodiment, the waveform pattern memory 56 may store only one set of waveform pattern signals WP1 or WP2 therein, and determine whether to directly select the stored set or to derive another set from the stored set. For example, through phase shifting, another set of waveform pattern signals may be derived from the stored set of waveform pattern signals. Generally speaking, in various display controllers according to the present invention, the waveform pattern memory 56 may compress or simplify the data amount necessarily stored therein through a variety of appropriate techniques and algorithms as long as the waveform pattern memory 56 is able to correctly output the desired bits WPB of waveform pattern signals, one bit per frame, in response to the transferred gradation data GD, the waveform pattern selecting signal WS, and the frame number signal FN.

FIG. 5(*b*) shows part of the circuit of FIG. 5(*a*) for illustrating one example of the waveform pattern selector 57 according to the present invention. Referring to FIG. 5(*b*), the waveform pattern selector 57 may be easily implemented by an Exclusive-OR logical circuit because there are two sets of waveform pattern signal WP1 and WP2 employed in the present invention and spatially arranged in accordance with the elementary 2×2 pixel cell 30 shown in FIG. 3(*a*). More specifically, the Exclusive-OR logical circuit receives a least significant bit $CN_{LSB}$ of the column number signal CN from the pixel counter 53 and a least significant bit $RN_{LSB}$ of the row number signal RN from the scan line counter 54. As clearly understood from the truth table of the Exclusive-OR logical circuit, the output logical value is 0 if the two input logical values are identical with respect to each other while the output logical value is 1 if the two input logical values are different with respect to each other. Consequently, the Exclusive-OR logical circuit is able to effectively distinguish between the two pairs of pixels located along the two diagonals of the elementary 2×2 pixel cell 30 shown in FIG. 3(*a*), respectively.

To sum up, the display controller according to the present invention is able to produce the $2^n$-gradation images on the binary display device through using only two sets of waveform pattern signals. As compared with plenty of prior art display techniques using much more sets of phase shifting signals and elaborate phase placement patterns and/or the cumbersome dithering matrices, the display controller according to the present invention significantly reduces the storage requirement of the waveform pattern memory 56 and replaces the prior art phase placement pattern memory or the dithering matrix registers with the elegantly-configured waveform pattern selector 57, thereby greatly enhancing the speed of processing digital image signals.

Hereinafter will be exemplarily described how to apply the display controller according to the present invention to color display devices with reference to FIGS. 6(*a*) to 6(*c*). Referring to FIG. 6(*a*), a color display device 60 is formed by a plurality of pixels in an array, each of which is constructed to produce one of three primary colors: red (R), green (G), and blue (B). In the color display device 60, one red pixel (e.g., $R_{11}$), one green pixel (e.g., $G_{11}$), and one blue pixel (e.g., $B_{11}$) are typically arranged together for making up a color pixel unit 61 in order to produce a desired color. Although there is only one kind of arrangement regarding the three primary color pixels illustrated in FIG. 6(*a*), the present invention is not limited to this example and may be applied to other appropriate kinds of arrangement regarding the three primary color pixels used in color display industry.

FIG. 6(*b*) shows a first method of assigning the two sets of waveform pattern signals WP1 and WP2 to the color display device 60 according to the present invention. In the first manner, each pixel of the color display device 60 is individually considered as a minimum assigned unit regardless of its color. Therefore, the pixels of the color display device 60 are assigned in accordance with the elementary 2×2 pixel cell 30, regardless of their color, for alternately, both vertically and horizontally, receiving the two sets of waveform pattern signal WP1 and WP2.

FIG. 6(*c*) shows a second method of assigning the two sets of waveform pattern signals WP1 and WP2 to the color display device 60 according to the present invention. In the second manner, each color pixel unit 61 consisting of the red, green, and blue pixels of the color display device 60 is individually considered as a minimum assigned unit. If the original four pixels of the elementary 2×2 pixel cell 30 shown in FIG. 3(*a*) are generalized to be representative of four color pixel units 61, it is still effective for the color pixel units 61 of the color display device 60 to be arranged in accordance with the elementary 2×2 pixel cell 30. In this case, the color pixel units 61 of the color display device 60 receive the two sets of waveform pattern signal WP1 and WP2 alternately, both vertically and horizontally. All of the three pixels in the same color pixel unit 61 receive the same set of waveform pattern signals.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

The invention claimed is:

1. A display controller for producing a multi-gradation image on a display device formed by a plurality of binary-state pixels in an array through a plurality of consecutive frames, the plurality of binary-state pixels being classified into a plurality of pixel groups having an identical size, the display controller comprising:

column addressing means for designating a column number of a desired pixel;

row addressing means for designating a row number of the desired pixel;

an image memory for providing gradation data in response to the column and row numbers of the desired pixel, the gradation data being indicative of a gradation level to be produced at the desired pixel;

a waveform pattern memory for providing the display device with plural sets of waveform pattern signals, each set having an identical number of waveform pattern signals, each waveform pattern signal having a predetermined number of bits and producing a different gradation level when applied to a pixel, each bit being provided for displaying during a corresponding frame of the plurality of consecutive frames; and a waveform pattern selector for outputting a waveform pattern selecting signal in response to the column and row numbers of the desired pixel such that the waveform pattern memory provides two adjacent pixel groups with two different sets of the plural sets of waveform pattern signals, respectively, wherein:

the waveform pattern memory determines a selected set of the plural sets of waveform pattern signals in response to the waveform pattern selecting signal, determines a selected waveform pattern signal of the selected set of waveform pattern signals in response to the gradation data, and provides the bits of the selected waveform pattern signal, one bit per frame, over the plurality of consecutive frames;

the two different sets of the plural sets of waveform pattern signals provided for the two adjacent pixel groups, respectively, are so designed as to operate the two adjacent pixel groups at two different states during at least one frame of the plurality of consecutive frames; and the plurality of consecutive frames is displayed at a frame rate high enough for preventing visual disturbances.

2. The display controller according to claim 1, wherein: the frame rate is equal to or higher than 120 Hz.

3. The display controller according to claim 1, wherein: the frame rate is equal to or higher than $(2^n \times 15)$ Hz where n is equal to or larger than 3.

4. The display controller according to claim 1, wherein: the waveform pattern memory is restricted to provide only two sets of waveform pattern signals.

5. The display controller according to claim 4, wherein: the waveform pattern memory stores a first set of the two sets of waveform pattern signals and derives a second set of the two sets of waveform pattern signals from the first set of the two sets of waveform pattern signals by using the waveform pattern selecting signal.

6. The display controller according to claim 4, wherein: the waveform pattern selecting signal is a binary selecting signal, which is restricted to select between the two sets of waveform pattern signals.

7. The display controller according to claim 4, wherein: the multi-gradation image has $2^m$ gradations and is produced through consecutive $2^n$ frames where m is equal to or smaller than n and n is equal to or larger than 3, and each set of the two sets of waveform pattern signals has $2^m$ waveform pattern signals for producing the $2^m$ gradations, respectively, each waveform pattern signal having $2^n$ bits.

8. The display controller according to claim 7, wherein: the frame rate is equal to or higher than $(2^n \times 15)$ Hz.

9. The display controller according to claim 1, wherein: the waveform pattern selector outputs the waveform pattern selecting signal in response to a least significant bit of the column number and a least significant bit of the row number.

10. The display controller according to claim 9, wherein: the waveform pattern selector is implemented by an Exclusive-OR logical circuit such that the waveform pattern selecting signal is a result of an Exclusive-OR logical operation between the least significant bit of the column number and the least significant bit of the row number.

11. The display controller according to claim 1, wherein: each of the plurality of pixel groups is formed by a single pixel of the plurality of binary-state pixels.

12. The display controller according to claim 1, wherein: the display device is a color display device such that each of the plurality of binary-state pixels is constructed to produce one of three primary colors: red, green, and blue, and each of the plurality of pixel groups is formed by a single pixel of the plurality of binary-state pixels regardless of its color.

13. The display controller according to claim 1, wherein: the display device is a color display device such that every three pixels of the plurality of binary-state pixels makes up a color pixel unit and produces three primary colors: red, green, and blue, respectively, and each of the plurality of pixel groups is formed by a single one of the color pixel units.

14. The display controller according to claim 1, further comprising:

a look-up table coupled between the image memory and the waveform pattern memory for transferring the gradation data provided by the image memory, thereby expanding the number of bits of the gradation data.

15. The display controller according to claim 1, further comprising:

a look-up table coupled between the image memory and the waveform pattern memory for transferring the gradation data provided by the image memory, thereby performing Gamma corrections on the gradation data.

16. The display controller according to claim 1, wherein:

the column addressing means is implemented by a pixel counter.

17. The display controller according to claim 1, wherein:

the row addressing means is implemented by a scan line counter.

18. The display controller according to claim 1, further comprising:

a frame counter for sequentially indicating the waveform pattern memory with each of the plurality of consecutive frames.

19. A method of producing a multi-gradation image on a display device formed by a plurality of binary-state pixels in an array through a plurality of consecutive frames, comprising:

defining an elementary 2×2 pixel cell on the display device, the elementary 2×2 pixel cell having two pixels along a first diagonal and two pixels along a second diagonal;

defining a first set of waveform pattern signals and a second set of waveform pattern signals, each set having an identical number of waveform pattern signals, each waveform pattern signal having a predetermined number of bits and producing a different gradation level when applied to a pixel, each bit being provided for displaying during a corresponding frame of the plurality of consecutive frames;

providing the two pixels along the first diagonal with the first set of waveform pattern signals and the two pixels along the second diagonal with the second set of waveform pattern signals such that the two pixels along the first diagonal and the two pixels along the second diagonal are operated at different states during at least one frame of the plurality of consecutive frames; and displaying the plurality of consecutive frames at a frame rate high enough for preventing visual disturbances.

20. The method according to claim 19, wherein:

the multi-gradation image has $2^m$ gradations and is produced through consecutive $2^n$ frames where m is equal to or smaller than n and n is equal to or larger than 3;

each set of the first and second sets of waveform pattern signals has $2^m$ waveform pattern signals for producing the $2^m$ gradations, respectively, each waveform pattern signal having $2^n$ bits; and the frame rate is equal to or higher than $(2^n \times 15)$ Hz.

* * * * *